US006166344A

United States Patent [19]

Castonguay et al.

[11] Patent Number: 6,166,344

[45] Date of Patent: Dec. 26, 2000

[54] CIRCUIT BREAKER HANDLE BLOCK

[75] Inventors: Roger N. Castonguay, Terryville; Dave S. Christensen, Burlington; Girish Hassan, Plainville, all of Conn.

[73] Assignee: General Electric Company, Schenectady, N.Y.

[21] Appl. No.: 09/275,066

[22] Filed: Mar. 23, 1999

[51] Int. Cl.[7] ..... H01H 23/00

[52] U.S. Cl. ..... 200/401; 200/325

[58] Field of Search ..... 200/327, 325

[56] References Cited

U.S. PATENT DOCUMENTS

| | | | |
|---|---|---|---|
| D. 367,265 | 2/1996 | Yamagata et al. | D13/160 |
| 2,340,682 | 2/1944 | Powell | 200/147 |
| 2,719,203 | 9/1955 | Gelzheiser et al. | 200/144 |
| 2,937,254 | 5/1960 | Ericson | 200/114 |
| 3,158,717 | 11/1964 | Jencks et al. | 200/116 |
| 3,162,739 | 12/1964 | Klein et al. | 200/88 |
| 3,197,582 | 7/1965 | Norden | 200/50 |
| 3,307,002 | 2/1967 | Cooper | 200/116 |
| 3,517,356 | 6/1970 | Hanarusa | 335/16 |
| 3,631,369 | 12/1971 | Menocal | 337/110 |
| 3,803,455 | 4/1974 | Willard | 317/33 SC |
| 3,883,781 | 5/1975 | Cotton | 317/14 R |
| 4,129,762 | 12/1978 | Bruchet | 200/153 G |
| 4,144,513 | 3/1979 | Shafer et al. | 335/46 |
| 4,158,119 | 6/1979 | Krakik | 200/240 |
| 4,165,453 | 8/1979 | Hennemann | 200/153 G |
| 4,166,988 | 9/1979 | Ciarcia et al. | 335/9 |
| 4,220,934 | 9/1980 | Wafer et al. | 335/16 |
| 4,255,732 | 3/1981 | Wafer et al. | 335/16 |
| 4,259,651 | 3/1981 | Yamat | 335/16 |
| 4,263,492 | 4/1981 | Maier et al. | 200/288 |
| 4,276,527 | 6/1981 | Gerbert-Gaillard et al. | 335/39 |
| 4,297,663 | 10/1981 | Seymour et al. | 335/20 |
| 4,301,342 | 11/1981 | Castonguay et al. | 200/153 SC |
| 4,360,852 | 11/1982 | Gilmore | 361/98 |
| 4,368,444 | 1/1983 | Preuss et al. | 335/166 |
| 4,375,021 | 2/1983 | Pardini et al. | 200/147 B |
| 4,375,022 | 2/1983 | Daussin et al. | 200/148 R |
| 4,376,270 | 3/1983 | Staffen | 335/21 |
| 4,383,146 | 5/1983 | Bur | 200/17 R |

(List continued on next page.)

FOREIGN PATENT DOCUMENTS

| | | |
|---|---|---|
| 897 691 | of 0000 | Belgium . |
| 819 008 | 12/1974 | Belgium . |
| 2 410 353 | 6/1979 | European Pat. Off. . |
| 0 061 092 | 9/1982 | European Pat. Off. . |
| 0 064 906 | 11/1982 | European Pat. Off. . |
| 0 066 486 | 12/1982 | European Pat. Off. . |
| 0 076 719 | 4/1983 | European Pat. Off. . |
| 0 117 094 | 8/1984 | European Pat. Off. . |
| 0 140 761 | 5/1985 | European Pat. Off. . |
| 0 174 904 | 3/1986 | European Pat. Off. . |
| 0 196 241 | 10/1986 | European Pat. Off. . |
| 0 224 396 | 6/1987 | European Pat. Off. . |
| 0 235 479 | 9/1987 | European Pat. Off. . |
| 0 239 460 | 9/1987 | European Pat. Off. . |
| 0 258 090 | 3/1988 | European Pat. Off. . |
| 0 264 313 | 4/1988 | European Pat. Off. . |
| 0 264 314 | 4/1988 | European Pat. Off. . |
| 0 283 189 | 9/1988 | European Pat. Off. . |
| 0 283 358 | 9/1988 | European Pat. Off. . |
| 0 283358 | 9/1988 | European Pat. Off. . |
| 0 291 374 | 11/1988 | European Pat. Off. . |
| 0 295 155 | 12/1988 | European Pat. Off. . |
| 0 295 158 | 12/1988 | European Pat. Off. . |
| 0 309 923 | 4/1989 | European Pat. Off. . |
| 0 313 106 | 4/1989 | European Pat. Off. . |
| 0 313 422 | 4/1989 | European Pat. Off. . |

(List continued on next page.)

*Primary Examiner*—Michael L. Gellner
*Assistant Examiner*—Nhung Nguyen
*Attorney, Agent, or Firm*—Cantor Colburn LLP

[57] ABSTRACT

A circuit breaker having a crank for coupling a switching mechanism to the contact pole structure is presented. The crank has a pair of cam surfaces which cooperate with a blocking lever to restrict movement of the operating handle when the contacts of the circuit breaker are welded. The blocking lever is arranged such that it does not interfere with the handle under normal operating conditions.

8 Claims, 7 Drawing Sheets

U.S. PATENT DOCUMENTS

| | | | |
|---|---|---|---|
| 4,392,036 | 7/1983 | Troehel et al. | 200/322 |
| 4,393,283 | 7/1983 | Masuda | 200/51.09 |
| 4,401,872 | 8/1983 | Boichot-Castagne et al. | 200/153 G |
| 4,409,573 | 10/1983 | DiMarco et al. | 335/16 |
| 4,435,690 | 3/1984 | Link et al. | 335/37 |
| 4,467,297 | 8/1984 | Boichot-Castagne et al. | 335/8 |
| 4,468,645 | 8/1984 | Gerbert-Gaillard et al. | 335/42 |
| 4,470,027 | 9/1984 | Link et al. | 335/16 |
| 4,479,143 | 10/1984 | Watanabe et al. | 358/44 |
| 4,488,133 | 12/1984 | McClellan et al. | 335/16 |
| 4,492,941 | 1/1985 | Nagel | 335/13 |
| 4,541,032 | 9/1985 | Schwab | 361/331 |
| 4,546,224 | 10/1985 | Mostosi | 200/153 G |
| 4,550,360 | 10/1985 | Dougherty | 361/93 |
| 4,562,419 | 12/1985 | Preuss et al. | 335/195 |
| 4,589,052 | 5/1986 | Dougherty | 361/94 |
| 4,595,812 | 6/1986 | Tamaru et al. | 200/307 |
| 4,611,187 | 9/1986 | Banfi | 335/16 |
| 4,612,430 | 9/1986 | Sloan et al. | 200/327 |
| 4,616,198 | 10/1986 | Pardini | 335/16 |
| 4,622,444 | 11/1986 | Kandatsu et al. | 200/303 |
| 4,631,625 | 12/1986 | Alexander et al. | 361/94 |
| 4,642,431 | 2/1987 | Tedesco et al. | 200/153 G |
| 4,644,438 | 2/1987 | Puccinelli et al. | 361/75 |
| 4,649,247 | 3/1987 | Preuss et al. | 200/244 |
| 4,658,322 | 4/1987 | Rivera | 361/37 |
| 4,672,501 | 6/1987 | Bilae et al. | 361/96 |
| 4,675,481 | 6/1987 | Markowski et al. | 200/144 R |
| 4,682,264 | 7/1987 | Demeyer | 361/96 |
| 4,689,712 | 8/1987 | Demeyer | 361/96 |
| 4,694,373 | 9/1987 | Demeyer | 361/96 |
| 4,710,845 | 12/1987 | Demeyer | 361/96 |
| 4,717,985 | 1/1988 | Demeyer | 361/96 |
| 4,733,211 | 3/1988 | Castonguay et al. | 335/192 |
| 4,733,321 | 3/1988 | Lindeperg | 361/96 |
| 4,764,650 | 8/1988 | Bur et al. | 200/153 G |
| 4,768,007 | 8/1988 | Mertz et al. | 335/202 |
| 4,780,786 | 10/1988 | Weynachter et al. | 361/87 |
| 4,831,221 | 5/1989 | Yu et al. | 200/553 |
| 4,870,531 | 9/1989 | Danek | 361/93 |
| 4,883,931 | 11/1989 | Batteux et al. | 200/148 R |
| 4,884,047 | 11/1989 | Baginski et al. | 335/10 |
| 4,884,164 | 11/1989 | Dziura et al. | 361/97 |
| 4,900,882 | 2/1990 | Bernard et al. | 200/147 R |
| 4,910,485 | 3/1990 | Bolongeat-Mobleau et al. | 335/195 |
| 4,914,541 | 4/1990 | Tripodi et al. | 361/94 |
| 4,916,420 | 4/1990 | Bartolo et al. | 335/172 |
| 4,916,421 | 4/1990 | Pardini et al. | 335/185 |
| 4,926,282 | 5/1990 | McGhie | 361/102 |
| 4,935,590 | 6/1990 | Malkin et al. | 200/148 A |
| 4,937,706 | 6/1990 | Schueller et al. | 361/396 |
| 4,939,492 | 7/1990 | Raso et al. | 335/42 |
| 4,943,691 | 7/1990 | Mertz et al. | 200/151 |
| 4,943,888 | 7/1990 | Jacob et al. | 361/96 |
| 4,950,855 | 8/1990 | Bolonegeat-Mobleu et al. | 200/148 A |
| 4,951,019 | 8/1990 | Gula | 335/166 |
| 4,952,897 | 8/1990 | Barnel et al. | 335/147 |
| 4,958,135 | 9/1990 | Baginski et al. | 335/8 |
| 4,965,543 | 10/1990 | Batteux | 335/174 |
| 4,983,788 | 1/1991 | Pardini | 200/16 R |
| 5,001,313 | 3/1991 | Leclerq et al. | 200/148 B |
| 5,004,878 | 4/1991 | Seymour et al. | 200/144 R |
| 5,029,301 | 7/1991 | Nebon et al. | 335/16 |
| 5,030,804 | 7/1991 | Abri | 200/323 |
| 5,057,655 | 10/1991 | Kersusan et al. | 200/148 B |
| 5,077,627 | 12/1991 | Fraisse | 361/93 |
| 5,083,081 | 1/1992 | Barrault et al. | 324/126 |
| 5,095,183 | 3/1992 | Raphard et al. | 200/148 A |
| 5,103,198 | 4/1992 | Morel et al. | 335/6 |
| 5,115,371 | 5/1992 | Tripodi | 361/106 |
| 5,120,921 | 6/1992 | DiMarco et al. | 200/401 |
| 5,132,865 | 7/1992 | Mertz et al. | 361/6 |
| 5,138,121 | 8/1992 | Streich et al. | 200/293 |
| 5,140,115 | 8/1992 | Morris | 200/308 |
| 5,153,802 | 10/1992 | Mertz et al. | 361/18 |
| 5,155,315 | 10/1992 | Malkin et al. | 200/148 R |
| 5,166,483 | 11/1992 | Kersusan et al. | 200/144 A |
| 5,172,087 | 12/1992 | Castonguay et al. | 335/160 |
| 5,178,504 | 1/1993 | Falchi | 411/553 |
| 5,184,717 | 2/1993 | Chou et al. | 200/401 |
| 5,187,339 | 2/1993 | Lissandrin | 200/148 F |
| 5,198,956 | 3/1993 | Dvorak | 361/106 |
| 5,200,724 | 4/1993 | Gula et al. | 335/166 |
| 5,210,385 | 5/1993 | Morel et al. | 200/146 R |
| 5,239,150 | 8/1993 | Bolongeat-Mobleau et al. | 200/148 R |
| 5,260,533 | 11/1993 | Livesey et al. | 200/401 |
| 5,262,744 | 11/1993 | Arnold et al. | 335/8 |
| 5,280,144 | 1/1994 | Bolongeat-Mobleau et al. | 200/148 R |
| 5,281,776 | 1/1994 | Morel et al. | 200/144 |
| 5,296,660 | 3/1994 | Morel et al. | 200/146 R |
| 5,296,664 | 3/1994 | Crookston et al. | 200/401 |
| 5,298,874 | 3/1994 | Morel et al. | 335/8 |
| 5,300,907 | 4/1994 | Nereau et al. | 335/172 |
| 5,310,971 | 5/1994 | Vial et al. | 200/244 |
| 5,313,180 | 5/1994 | Vial et al. | 335/16 |
| 5,317,471 | 5/1994 | Izoard et al. | 361/105 |
| 5,331,500 | 7/1994 | Corcoles et al. | 361/93 |
| 5,334,808 | 8/1994 | Bur et al. | 200/50 |
| 5,341,191 | 8/1994 | Crookston et al. | 335/16 |
| 5,347,096 | 9/1994 | Bolongeat-Mobleau et al. | 200/148 B |
| 5,347,097 | 9/1994 | Bolongeat-Mobleau et al. | 200/148 B |
| 5,350,892 | 9/1994 | Rozier | 200/144 B |
| 5,357,066 | 10/1994 | Morel et al. | 200/17 R |
| 5,357,068 | 10/1994 | Rozier | 200/148 R |
| 5,357,394 | 10/1994 | Piney | 361/72 |
| 5,361,052 | 11/1994 | Ferullo et al. | 335/172 |
| 5,373,130 | 12/1994 | Barrault et al. | 200/147 R |
| 5,379,013 | 1/1995 | Coudert | 335/17 |
| 5,424,701 | 6/1995 | Castonguary et al. | 335/172 |
| 5,438,176 | 8/1995 | Bonnardel et al. | 200/400 |
| 5,440,088 | 8/1995 | Coudert et al. | 200/303 |
| 5,449,871 | 9/1995 | Batteux et al. | 200/401 |
| 5,450,048 | 9/1995 | Leger et al. | 335/132 |
| 5,451,729 | 9/1995 | Onderka et al. | 200/18 |
| 5,457,295 | 10/1995 | Tanibe et al. | 200/293 |
| 5,467,069 | 11/1995 | Payet-Burin et al. | 335/42 |
| 5,469,121 | 11/1995 | Payet-Burin | 335/16 |
| 5,475,558 | 12/1995 | Barjonnet et al. | 361/64 |
| 5,477,016 | 12/1995 | Baginski et al. | 200/43.11 |
| 5,479,143 | 12/1995 | Payet-Burin | 335/202 |
| 5,483,212 | 1/1996 | Lankuttis et al. | 335/132 |
| 5,485,343 | 1/1996 | Santos et al. | 361/115 |
| 5,493,083 | 2/1996 | Olivier | 200/17 R |
| 5,504,284 | 4/1996 | Lazareth et al. | 200/50 R |
| 5,504,290 | 4/1996 | Baginski et al. | 200/401 |
| 5,510,761 | 4/1996 | Boder et al. | 335/172 |
| 5,512,720 | 4/1996 | Coudert et al. | 200/400 |
| 5,515,018 | 5/1996 | DiMarco et al. | 335/16 |
| 5,519,561 | 5/1996 | Mrenna et al. | 361/105 |
| 5,534,674 | 7/1996 | Steffens | 218/154 |
| 5,534,832 | 7/1996 | Duchemin et al. | 335/16 |
| 5,534,835 | 7/1996 | McColloch et al. | 335/172 |
| 5,534,840 | 7/1996 | Cuingnet | 337/1 |
| 5,539,168 | 7/1996 | Linzenich | 200/303 |
| 5,543,595 | 8/1996 | Mader et al. | 200/401 |
| 5,552,755 | 9/1996 | Fello et al. | 335/18 |
| 5,581,219 | 12/1996 | Nozawa et al. | 335/132 |
| 5,604,656 | 2/1997 | Derrick et al. | 361/187 |
| 5,608,367 | 3/1997 | Zoller et al. | 335/132 |
| 5,784,233 | 7/1998 | Bastard et al. | 361/36 |

FOREIGN PATENT DOCUMENTS

| | | |
|---|---|---|
| 0 314 540 | 5/1989 | European Pat. Off. . |
| 0 331 586 | 9/1989 | European Pat. Off. . |
| 0 337 900 | 10/1989 | European Pat. Off. . |
| 0 342 133 | 11/1989 | European Pat. Off. . |
| 0 367 690 | 5/1990 | European Pat. Off. . |
| 0 371 887 | 6/1990 | European Pat. Off. . |
| 0 375 568 | 6/1990 | European Pat. Off. . |
| 0 394 144 | 10/1990 | European Pat. Off. . |
| 0 394 922 | 10/1990 | European Pat. Off. . |
| 0 399 282 | 11/1990 | European Pat. Off. . |
| 0 407 310 | 1/1991 | European Pat. Off. . |
| 0 452 230 | 10/1991 | European Pat. Off. . |
| 0 555 158 | 8/1993 | European Pat. Off. . |
| 0 567 416 | 10/1993 | European Pat. Off. . |
| 0 595 730 | 5/1994 | European Pat. Off. . |
| 0 619 591 | 10/1994 | European Pat. Off. . |
| 0 665 569 | 8/1995 | European Pat. Off. . |
| 0 700 140 | 3/1996 | European Pat. Off. . |
| 2 512 582 | 3/1983 | France . |
| 2 553 943 | 4/1985 | France . |
| 2 592 998 | 7/1987 | France . |
| 2 682 531 | 4/1993 | France . |
| 2 697 670 | 5/1994 | France . |
| 2 699 324 | 6/1994 | France . |
| 2 174 771 | 7/1995 | France . |
| 2 714 771 | 7/1995 | France . |
| 12 27 978 | 11/1966 | Germany . |
| 30 47 360 | 6/1982 | Germany . |
| 38 02 184 | 3/1989 | Germany . |
| 38 02 184 | 8/1989 | Germany . |
| 38 43 277 | 6/1990 | Germany . |
| 44 19 240 | 1/1995 | Germany . |
| 1 227 978 | of 0000 | U.S.S.R. . |
| 2 233 155 | 1/1991 | United Kingdom . |
| 92/00598 | 1/1992 | WIPO . |
| 92/05649 | 4/1992 | WIPO . |
| 94/00901 | 1/1994 | WIPO . |

CIRCUIT BREAKER HANDLE BLOCK

FIELD OF INVENTION

The present invention relates generally to circuit breakers and more particularly to circuit breaker operating mechanisms having a handle blocking means for restricting movement of the handle when the current carrying contacts are welded.

BACKGROUND OF THE INVENTION

Molded case current limiting circuit breakers are well known in the art. Circuit breakers of this type have a manual operating handle for the purpose of switching the circuit breaker between on and off states. The on-off operation is accomplished through a mechanism spring that connects the operating handle with a toggle linkage. The toggle linkage in turn is connected to a contact carrier assembly that performs the operation of connecting and interrupting current flow to a protected circuit.

When the operating handle is moved from the on to the off position, the direction of the force applied by the mechanism spring changes as the spring rotates with the handle. At some point during the motion, the direction of the force changes from one side of a toggle linkage pivot to the other. This results in the toggle linkage collapsing and rotation of the contact carrier assembly.

The circuit breaker generally provides some visual indication as to the position of the contact carrier assembly. However, on extreme and rare occasions the contacts of the circuit breaker can become welded. In this case if the operating handle were allowed to be returned to the off position, it would give the operator the false indication that the protected circuit has been disconnected from the power source. Some regulatory agencies such as the International Electrotechnical Commission (IEC) require that the operating handle be blocked from moving to the off position when the contacts are welded. It is also required by such regulatory agencies that the circuit breaker indicate the position of the contacts. In many circuit breakers when the contacts are welded, the handle automatically returns to the on position. This not only provides correct visual indication of the state of the contacts, but also provides the operator with an indication that there is some malfunction.

A circuit breaker of the type mentioned herein having a mechanism with the toggle type linkage that is described in U.S. Pat. No. 5,200,724. In this circuit breaker the handle movement is blocked by projections extending from both the upper link and the lower link of the toggle linkage. The upper link projection interacts with the handle to block handle rotation while the lower link projection interacts with a crossbar assembly to prevent rotation of the toggle linkage.

Further, U.S. Pat. No. 5,543,595 describes a circuit breaker, which utilizes reversing levers that are attached to a cradle. The reversing levers interact with an upper link and the handle to prevent rotation of the handle to a position where the toggle linkage can rotate if the contacts are welded.

SUMMARY OF INVENTION

In an exemplary embodiment of the present invention, a molded case circuit breaker includes a mechanism having a handle, movable between an on and off position, with the handle having a blocking projection extending therefrom for restricting movement of the handle when the contacts of the circuit breaker are welded or otherwise fixed in the ON position and prevented from opening. The circuit breaker also has a contact arm movable between a closed and open position in response to movement from the handle.

A crank is coupled to the handle and the contact arm such that when the handle is moved from the on position to the off position, the crank moves the contact arm from the closed position to the open position. A locking lever having a first projection is arranged to cooperate with the crank such that when the contact arm is fixed in the ON position the handle blocking projection interacts with the locking lever first projection to prevent the handle from being moved to the off position.

DESCRIPTION OF THE PREFERRED EMBODIMENT

Figure 1:
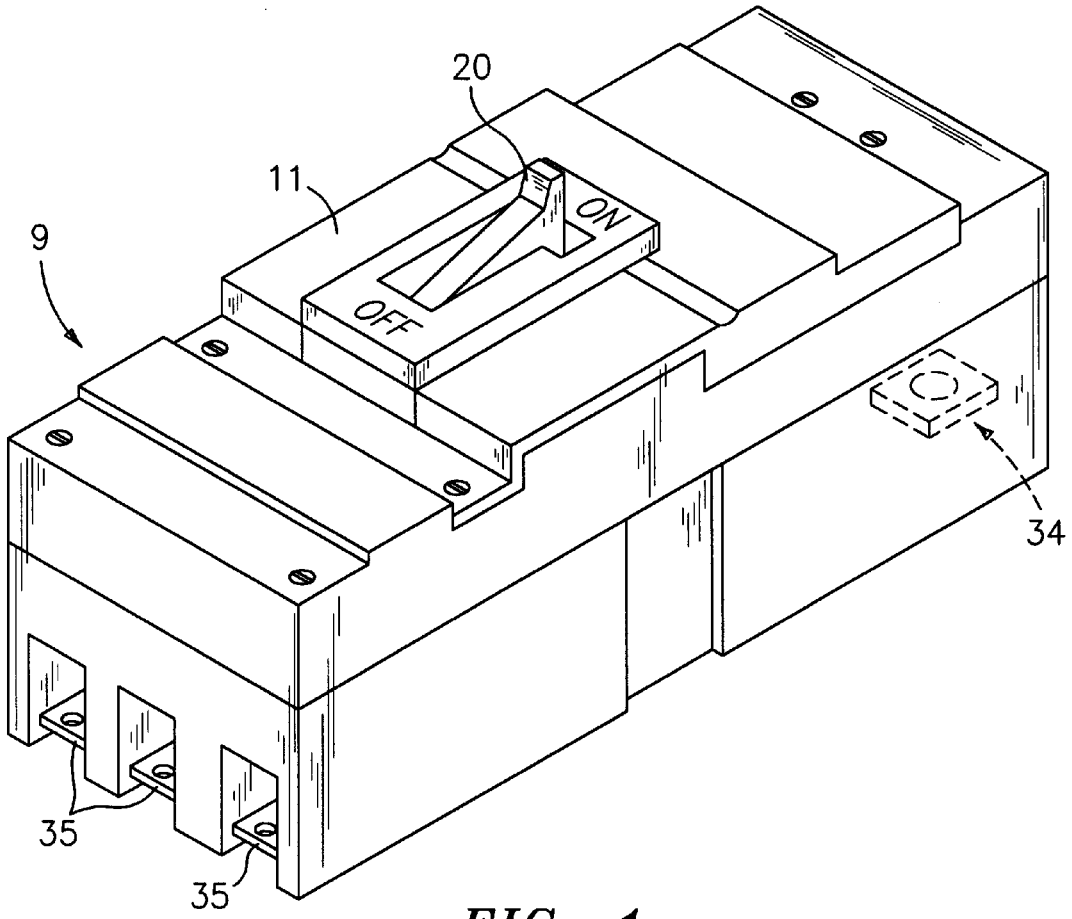
FIG. 1 is a perspective view of a circuit breaker in accordance with the present invention.

Referring to FIG. 1, a molded case circuit breaker 9 is generally shown. Circuit breakers of this type have an insulted case 11 that houses the components of the circuit breaker. A handle 20 extending through the case 11 gives the operator the ability to turn the circuit breaker "on" energizing the protected circuit, turn the circuit breaker "off" disconnecting the protected circuit or "reset" the circuit breaker after a fault. Two sets of straps 34, 35 also extend through the case 11 for connecting the circuit breaker 9 to the wires of the protected circuit. The circuit breaker in FIG. 1 shows a typical three phase configuration, however, the present invention is not limited to this configuration but may be applied to other configurations, such as the typical one, two or four phase circuit breakers.

Figure 2:
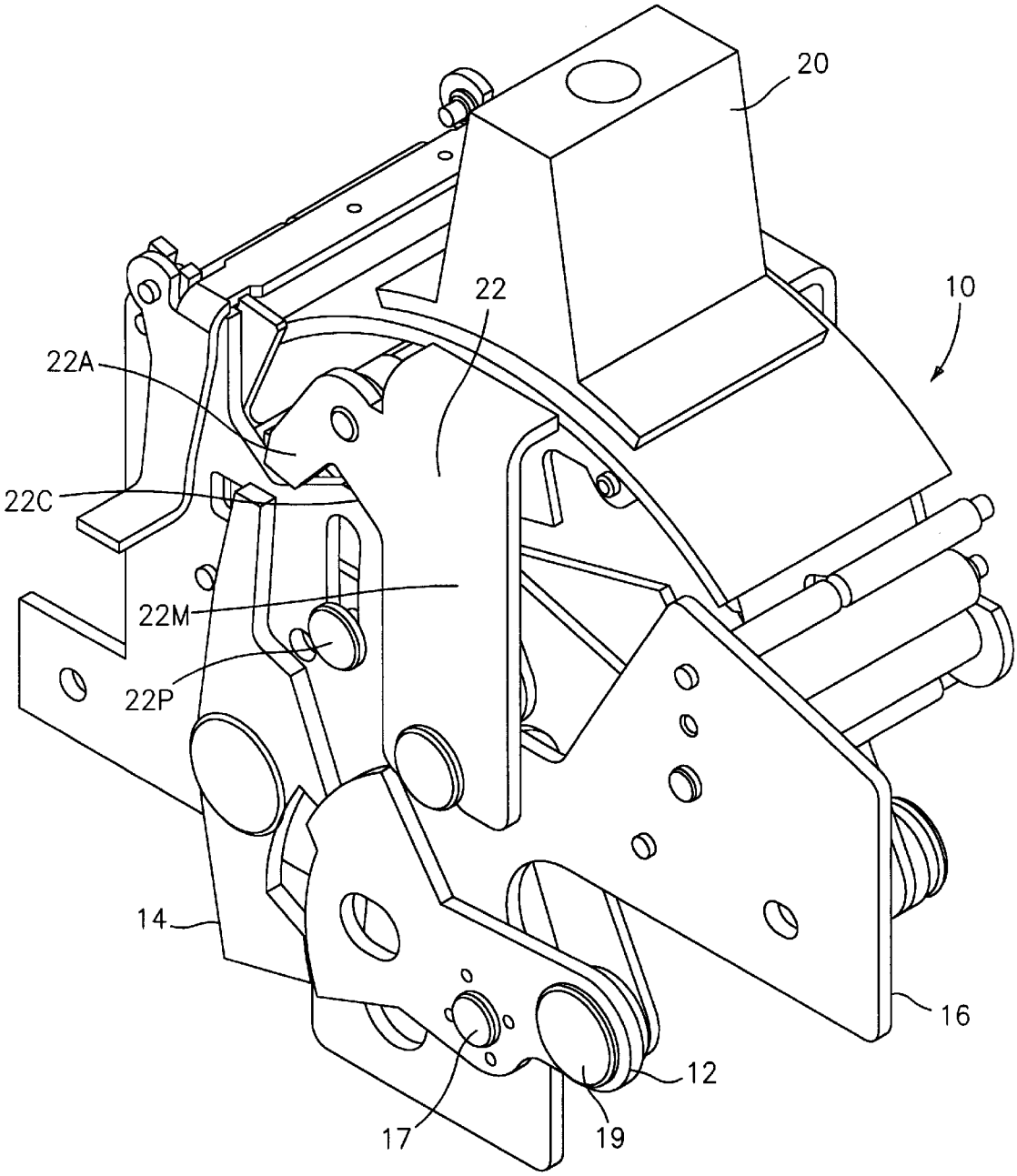
FIG. 2 is a perspective view of a mechanism for use with circuit breakers in accordance with the present invention.

The handle 20 is attached to an internal mechanism 10 as shown in FIG. 2. The handle 20 attaches to a handle yoke 22 which pivots on a pin 22P on the side frame 16. Normally there would be two side frames 16, but only one of which is shown in FIG. 2 for clarity. The handle yoke 22 consists of a main body 22M and a projection 22A, a cutout 22C is formed between the projection 22A and the main body 22M.

Figure 3:
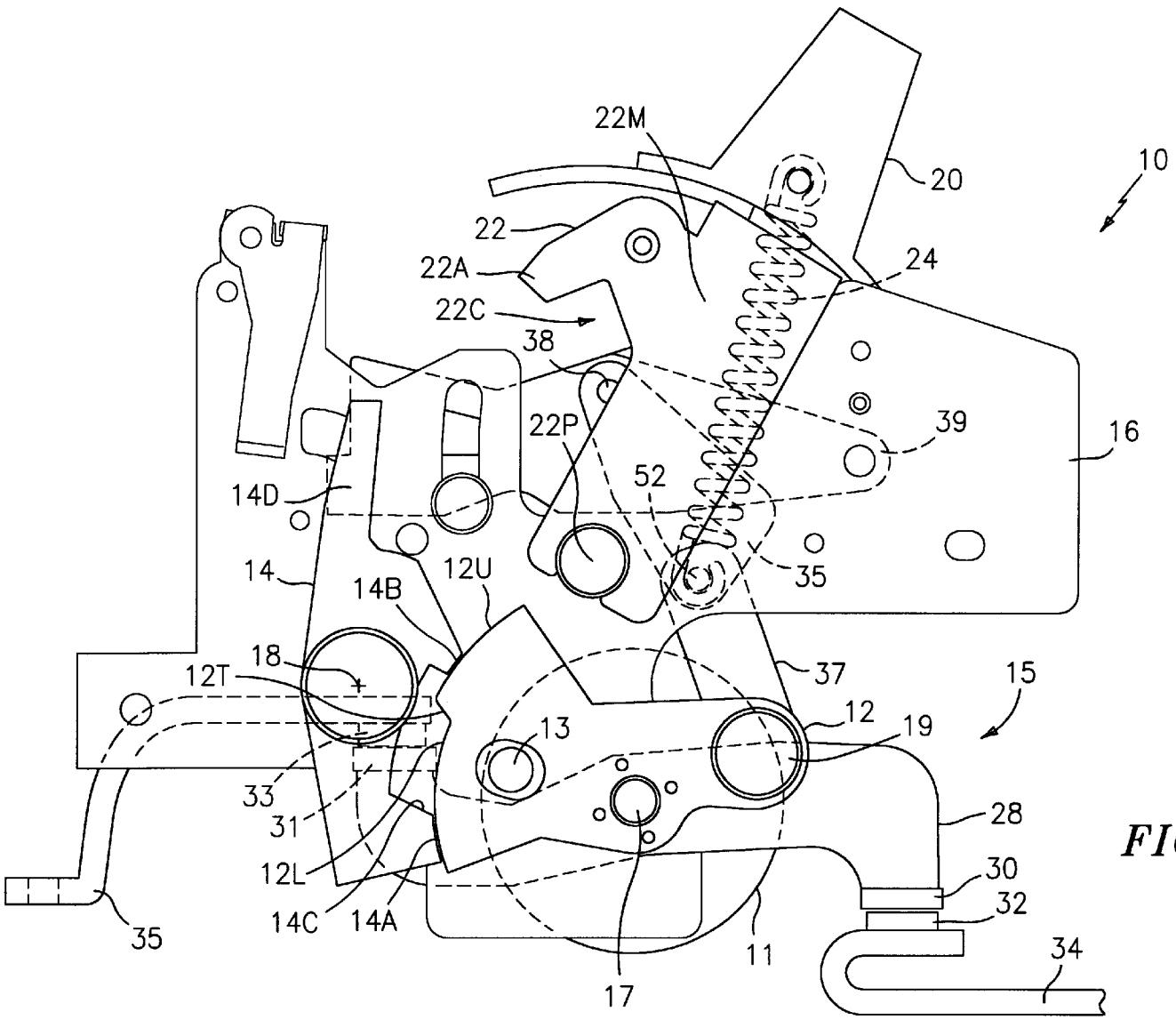
FIG. 3 is a front plan view of the mechanism of FIG. 1 in the ON position.

The remaining internal components of the circuit breaker are shown in FIG. 3. The handle 20 is attached to a mechanism spring 24 which attaches at its opposite end to a toggle pin 52. The toggle pin 52 connects the toggle linkage 35, 37 with the mechanism spring 24. As will be described herein, the force generated by the movement of the handle 20 will cause the toggle linkage 35, 37 to extend or collapse, which in turn results in the circuit breaker turning ON or OFF depending on the movement of the handle 20. The upper link 35 of the toggle linkage attaches to a cradle 39. The lower linkage 37 attaches to crank 12 via pin 19.

The crank 12 pivots on a pin 17 attached to the side frames 16 and connects with a multi-pole rotary contact system 15 via pin 13. The rotary contact system operates in substantially the same manner as that described in co-pending U.S. patent application titled "Circuit Breaker Mechanism for a Rotary Contact Assembly" Ser. No. 09/196,706 filed on Nov. 20, 1998 which is incorporated herein by reference. Adjacent to the pin 13, the crank 12 interacts with a blocking lever 14 which pivots on a pin 18 attached to the side frames 16. The interaction of the crank 12 with the blocking lever 14 will be made clearer herein.

The blocking lever 14 has a first and second surface 14A, 14B which adjoin the upper and lower surfaces 12U, 12L of the crank 12. Adjoining the blocking lever first surface 14A is a third surface 14C. Under certain operations, the blocking lever third surface 14C will contact a crank transition surface 33 which connects the crank upper surface 12U to the crank lower surface 12L. The blocking lever 14 also has a lever projection 14D which interacts with a handle yoke projection 22A. The importance of the interaction between the lever projection 14D and the handle yoke projection 22A will be made clearer herein.

The rotary contact system 15 includes a rotor 11 that attaches the crank 12 via pin 13. A contact arm 28 connects with the rotor 11 for purposes of opening and closing the circuit breaker. The contact arm 28 has a pair of movable contacts 30, 31 which electrically connect with a pair of stationary contacts 32, 33 respectively. The stationary contacts 32, 33 are attached to the straps 34, 35 respectively which allows electrical current to flow from the power source through the circuit breaker to the protected circuit.

Under normal operating conditions when the circuit breaker is in the ON position, the mechanism 10 and rotary contact system 15 will be oriented as shown in FIG. 3. In this orientation, the movable contacts 30, 31 mate with the stationary contacts 32, 33 to allow current to flow through the circuit breaker. In this position, the blocking lever first surface 14A rests against the crank lower surface 12L and the blocking lever second surface 14B contacts the crank upper surface 12U.

Figure 4:
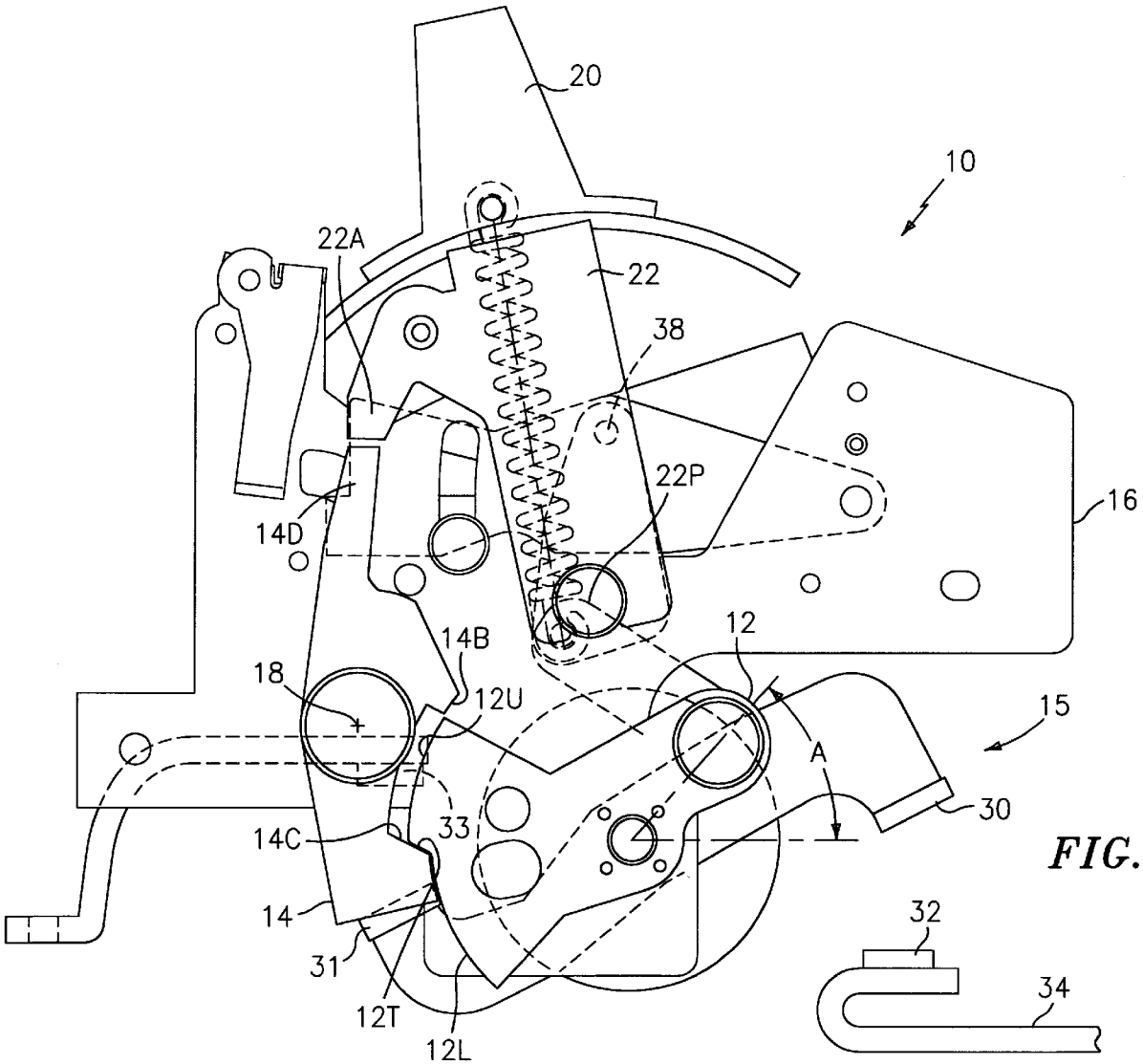
FIG. 4 is a front plan view of the mechanism of FIG. 1 in transition from the ON to the OFF position.
Figure 5:
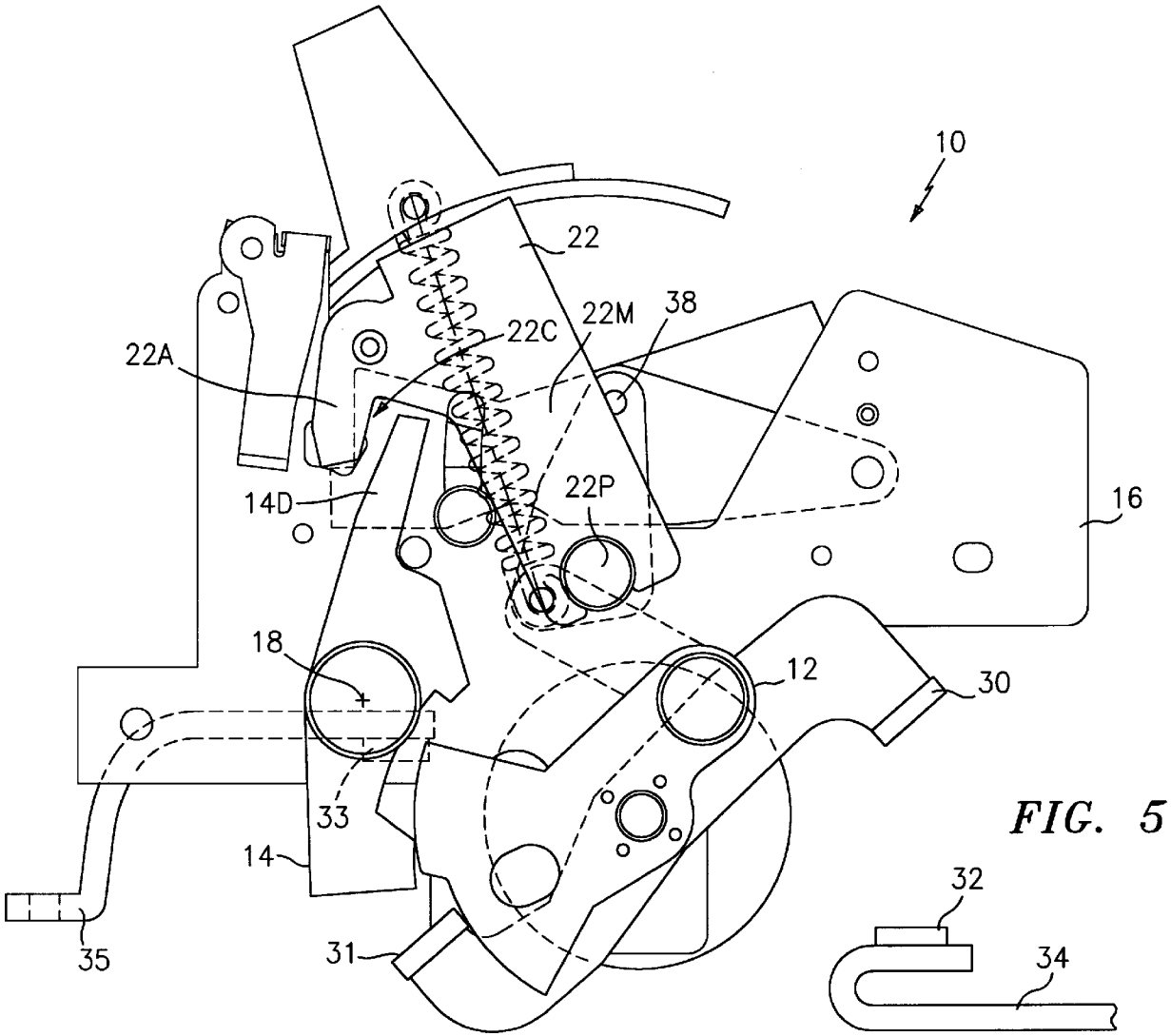
FIG. 5 is a front plan view of the mechanism of FIG. 1 in the OFF position.

When the users rotates the handle 20 to the OFF position (counter-clockwise as oriented in FIG. 2–7), the line of force generated by the mechanism spring 24 on the toggle pin 52 rotates with the handle. At the point where the line of force generated by the mechanism spring 24 crosses the upper link pin 38, the toggle linkage 35, 37 will collapse as shown in FIG. 4. This collapsing of the toggle linkage 35, 37 rotates the crank 12 in the counter-clockwise direction separating the moveable contacts 30, 31 from the stationary contacts 32, 33. When the contacts 30, 31, 32, 33 separate, electrical current flow through the circuit breaker is interrupted and the protected circuit is disconnected from the power source.

As the crank 12 continues to rotate to an angle A, the transition surface 12T contacts the blocking lever third surface 14C which bias the blocking lever to rotate in the clockwise direction. Since at this point the blocking lever second surface 14B is no longer in contact with the crank, the blocking lever 14 is free to rotate thereby allowing the projection 14D to extend into the handle yoke cutout 22C shown in FIG. 5. Since the projection 14D is not interfering with the handle yoke projection 22A, the user can rotate the handle 20 to the full OFF position shown in FIG. 5.

Under certain conditions, the contacts 30, 32 or 31, 33 may become welded together. This welded condition prevents the mechanism from separating the contacts 30, 32 and 31, 33 as described above to disconnect the protected circuit. Certain quasi-regulatory agencies such as the International Electrotechnical Commission (IEC) require that the mechanism handle 22 be prevented from moving to the OFF position while the contacts 30, 32, 31, 33 are welded. To accomplish this, the present invention provides a projection 14D on the blocking lever 14 to interfere with the handle yoke projection 22A to prevent the handle 22 from being placed in the OFF position and if the handle 22 is moved, it will automatically return to the ON position when the handle 22 is released.

Figure 6:
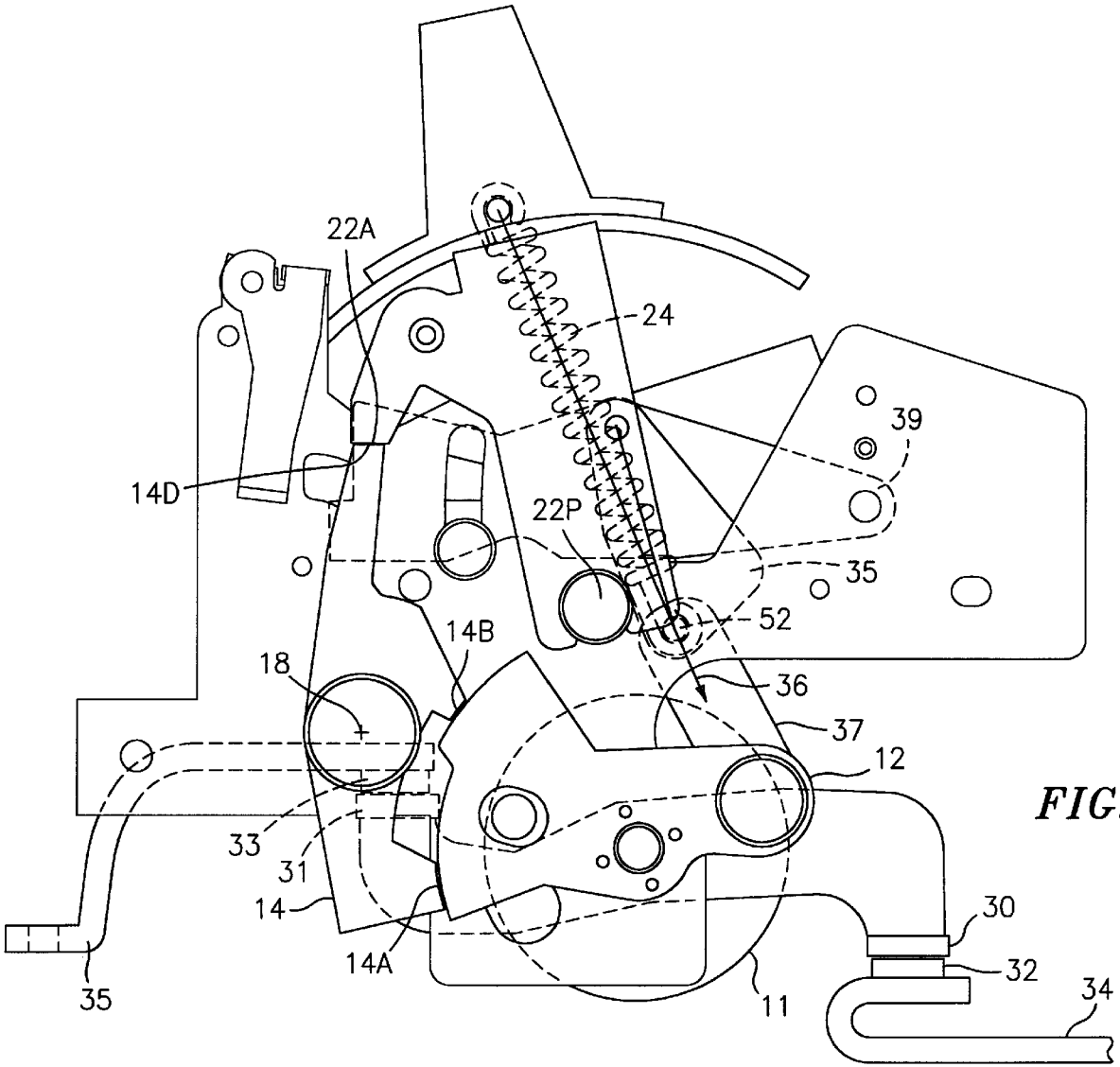
FIG. 6 is a front plan view of the mechanism of FIG. 1 where the handle is blocked due to welded contacts.

When the contacts 30, 32, 31, 33 are welded, the crank 12 will stay in the closed position shown in FIG. 6. If the user attempts to reset the breaker, the handle yoke 22 rotates until the yoke projection 22A contacts the lever projection 14D. Unlike the above situation, where the bias on the blocking lever 14 allowed the blocking lever 14 to rotate out of the path of the handle yoke 22, the blocking lever first and second surfaces 14A, 14B are both in contact with the crank 12. Thus, the blocking lever 14 is prevented from rotating clockwise by surface 14B, or counter-clockwise by surface 14A. Once the handle yoke 22A is interfered with by the blocking lever projection 14D, further counter-clockwise rotation of the handle 20 is prevented. It should be appreciated that once the handle 20 is released by the user, the line of force 36 on the handle 20 from the mechanism spring 24 will cause the handle yoke 22 and the handle 20 to rotate in the clockwise direction about the handle yoke pivot 22P until it reaches the ON position.

Figure 7:
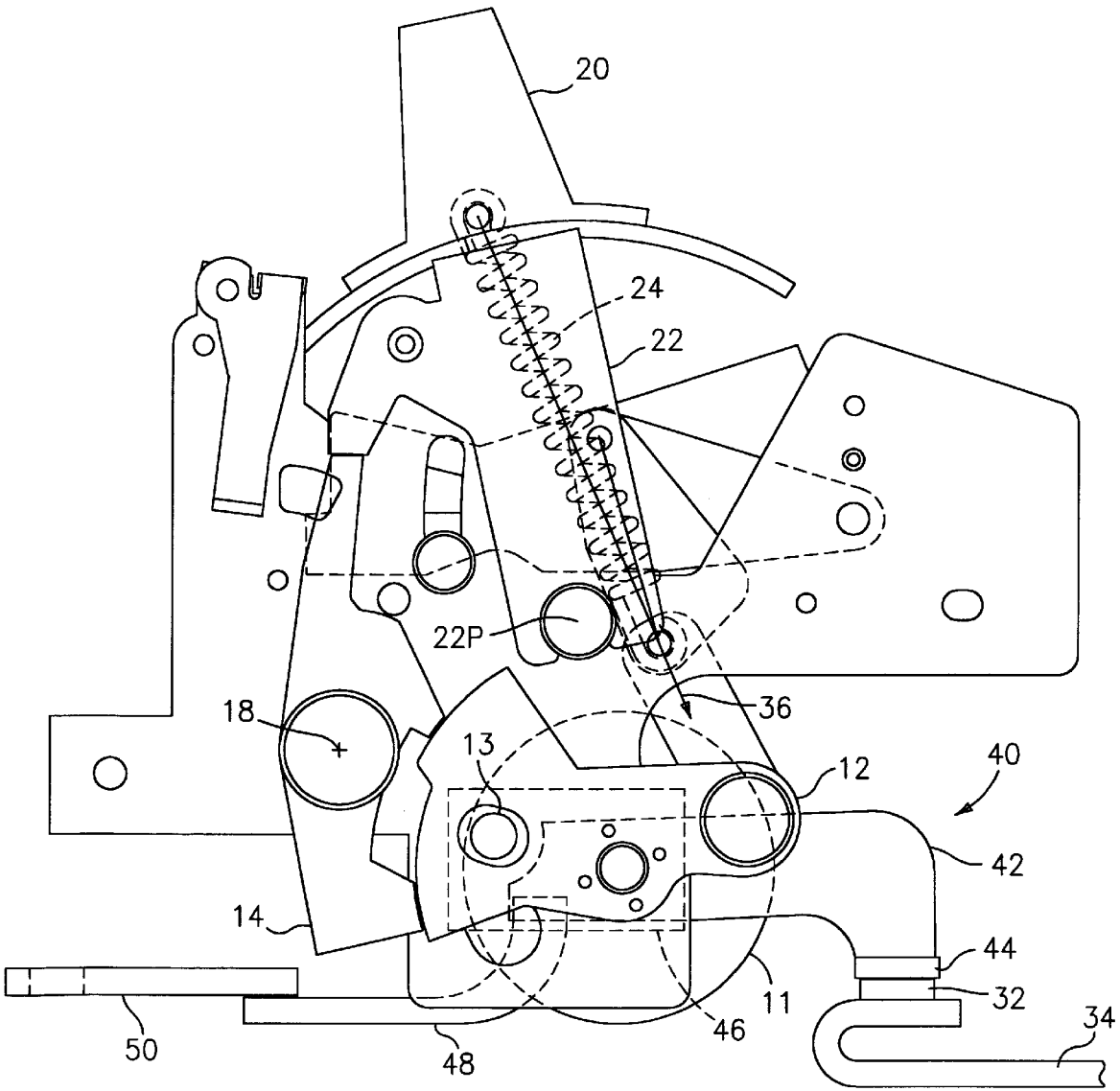
FIG. 7 is a front plan view of a mechanism for a single break contact system in accordance with an alternate embodiment of the present invention.

Referring to FIG. 7, an alternate embodiment is shown where the blocking lever is incorporated into a traditional single break contact system. In this embodiment, the contact arm assembly 40 consists of contact arm 42 having a movable contact 44 at on end and a copper braid 48 at the other. The moveable contact 44 mates with the stationary contact 32 to form an electrical connection with the previously discussed line strap 34. The copper braid 48 is connected at one end to the contact arm 42 and a load strap 50 at the other. The copper braid 48 may be connected to the contact arm 42 and strap 50 by other suitable means for creating an electrical connection, including a brazed or screwed joint. The contact arm 42 is connected to the mechanism 10 by a carrier 46 and the pin 13 that extends between the crank 12 and the carrier 46. The contact arm assembly 40 operation is well known, and is similar to the one described in U.S. Pat. No. 4,732,921 which is incorporated herein by reference.

Although a preferred embodiment of this invention has been described in a double contact-break rotary system it is within the scope of the present invention that this invention may be applied to any traditional circuit breaker mechanism having a single contact and any variations and modifications that will now be apparent to those skilled in the art. Therefore, it is preferred that the instant invention be limited not by the specific disclosure herein but only by the following claims.

We claim:

1. A circuit breaker (9) comprising:

a handle yoke having a projection extending therefrom, said handle yoke being movable betweenn an on position and an off position;

a contact arm supporting at least one contact, said contact arm being movable between a closed position and an open position;

a crank operably coupled to said handle yoke and said contact arm to move said contact arm from the closed position to the open position when said handle yoke is moved from the on position to the off position;

a blocking lever having a lever projection extending therefrom, said lever projection interacting with said projection of said handle yoke to prevent said handle yoke from being moved to the off position when said contact arm is fixed in the closed position.

2. The circuit breaker of claim 1, wherein:

said crank further comprises first and second cam surface and said blocking lever further comprises first and second surfaces cooperating with said first and second cam surfaces to rotate said blocking lever when said contact arm moves between the closed and open positions, without said lever projection or said blocking lever interacting with said projection of said handle yoke.

3. The circuit breaker of claim 2, wherein:

said crank further includes a transition surface between said first and second cam surfaces, said transition surface interacting with said first surface of said blocking lever to rotate said blocking lever when said contact arm moves between its closed and open positions, without said lever projection or said blocking lever interacting with said projection of said handle yoke or said handle yoke.

4. The circuit breaker of claim 1 wherein said at least one contact (30) comprises a contact (30) located at one end of said contact arm.

5. The circuit breaker of claim 1 wherein said at least one contact comprises a pair of contacts, each of said contacts located at an opposing end of said contact arm.

6. The circuit breaker of claim 1 further comprising:

a cradle;

a toggle linkage having an upper linkage and a lower linkage, said upper linkage being pivotally attached to said cradle at one end and to a toggle pivot at an opposite end, said lower linkage being pivotally attached to said toggle pivot at one end and to said crank at an opposite end; and a spring connected between said toggle pivot and said handle yoke to bias said crank in a direction for moving said contact arm to an open position when said handle yoke is moved from an off to on position.

7. The circuit breaker of claim 6 wherein:

said crank and said contact arm rotate on a common axis and said crank is coupled to said lower link at a first pin and said crank is coupled to said contact arm by a second pin, said second pin being offset from said axis.

8. The circuit breaker of claim 7 wherein said second pin is diametrically opposed to said first pin.

* * * * *